United States Patent [19]

Islip et al.

[11] Patent Number: 4,513,819

[45] Date of Patent: Apr. 30, 1985

[54] CYCLIC SOLVENT ASSISTED STEAM INJECTION PROCESS FOR RECOVERY OF VISCOUS OIL

[75] Inventors: Philip N. Islip, Plano; Winston R. Shu, Dallas, both of Tex.

[73] Assignee: Mobil Oil Corporation, New York, N.Y.

[21] Appl. No.: 584,186

[22] Filed: Feb. 27, 1984

[51] Int. Cl.[3] ..... E21B 43/24

[52] U.S. Cl. ..... 166/263; 166/272

[58] Field of Search ..... 166/263, 272

[56] References Cited

U.S. PATENT DOCUMENTS

| | | | |
|---|---|---|---|
| 2,862,558 | 12/1958 | Dixon | 166/272 |
| 3,483,924 | 12/1969 | Blevins et al. | 166/272 |
| 4,127,170 | 11/1978 | Redford | 166/263 X |
| 4,133,382 | 1/1979 | Cram et al. | 166/263 |
| 4,166,502 | 9/1979 | Hall et al. | 166/263 |
| 4,217,956 | 8/1980 | Goss et al. | 166/263 X |
| 4,271,905 | 6/1981 | Redford et al. | 166/263 |
| 4,398,602 | 8/1983 | Anderson | 166/263 X |
| 4,450,911 | 5/1984 | Shu et al. | 166/263 |

*Primary Examiner*—George A. Suchfield

*Attorney, Agent, or Firm*—Alexander J. McKillop; Michael G. Gilman; Malcolm D. Keen

[57] ABSTRACT

A method for recovering oil from a subterranean, viscous oil-containing formation employing a cyclical injection-production program in which first a mixture of steam and solvent are injected after which fluids including oil are produced until the water cut of the produced fluids reaches 95 percent. Thereafter, the sequence of injection of a solvent/steam mixture and production of fluids including oil is repeated for a plurality of cycles. The ratio of solvent to steam is 2 to 10 volume percent. The mixture of solvent and steam is injected into the lower portion of the formation in which adequate fluid communication exists or in which a communication path is first established. In another embodiment, after the initial solvent/steam injection-production cycle, steam or hot water is injected into the formation followed by production and drawdown of the formation.

10 Claims, No Drawings

CYCLIC SOLVENT ASSISTED STEAM INJECTION PROCESS FOR RECOVERY OF VISCOUS OIL

FIELD OF THE INVENTION AND BACKGROUND OF THE INVENTION

1. Field of the Invention

This invention pertains to an oil recovery method, and more specifically to a method for recovering viscous oil from subterranean, viscous oil-containing formations including tar sand deposits. Still more specifically, this method employs a cyclical injection-production program in which first a mixture of solvent and steam are injected followed by fluid production.

2. Background of the Invention

Many oil reservoirs have been discovered which contain vast quantities of oil, but little or no oil has been recovered from many of them because the oil present in the reservoir is so viscous that it is essentially immobile at reservoir conditions, and little or no petroleum flow will occur into a well drilled into the formation even if a natural or artifically induced pressure differential exists between the formation and the well. Some form of supplemental oil recovery must be applied to these formations which decrease the viscosity of the oil sufficiently that it will flow or can be dispersed through the formation to a production well and therethrough to the surface of the earth. Thermal recovery techniques are quite suitable for viscous oil formations, and steam flooding is the most successful thermal oil recovery technique yet employed commercially.

Steam may be utilized for thermal stimulation for viscous oil production by means of a steam drive or steam throughput process, in which steam is injected onto the formation on a more or less continuous basis by means of an injection well and oil is recovered from the formation from a spaced-apart production well.

Coinjection of solvents with steam into a heavy oil reservoir can enhance oil recovery by the solvent mixing with the oil and reducing its viscosity. The use of a solvent comingled with steam during a thermal recovery process is described in U.S. Pat. No. 4,127,170 to Redford and U.S. Pat. No. 4,166,503 to Hall.

Applicants' copending application Ser. Nos. 553,923 and 553,924, filed Nov. 21, 1983, respectively, disclose oil recovery processes wherein mixtures of steam and solvent are injected into the formation to maximize solvent efficiency.

SUMMARY

The present invention relates to a method for recovering oil from a subterranean, viscous oil-containing formation including a tar sand deposit, said formation being penetrated by at least one injection well in fluid communication with only the lower 50% or less of the oil-containing formation and by at least one spaced-apart production well in fluid communication with a substantial portion of the oil-containing formation, said injection well and said production well having a fluid communication relationship in the bottom zone of the formation, comprising (a) injecting into the formation via the injection well a predetermined amount of a mixture of steam and a solvent with the production well shut-in, (b) shutting-in the injection well and recovering fluids including oil from the formation via the production well until the fluid being recovered from the production well comprises a predetermined amount of water, and (c) repeating steps (a) and (b) for a plurality of cycles. The preferred amount of steam injected along with the solvent is 300 barrels of steam (cold water equivalent) per acre-foot of formation at a temperature of 300° to 700° F. and a steam quality of 50% to 90%. The solvent may be selected from the group consisting of $C_1$ to $C_{14}$ hydrocarbons, carbon dioxide, naphtha, kerosene, natural gasoline, syncrude, light crude oil and mixtures thereof. The ratio of solvent to steam is within the range of 2 to about 10 volume percent. The preferred solvent comprises a light $C_1$ to $C_4$ hydrocarbon with a solvent to steam ratio of 2 to 5 volume percent. In another embodiment, after the first sequence of steam/solvent injection followed by production, a slug of steam or hot water is injected followed by production. This sequence may be repeated for a plurality of cycles. In addition, the formation may be allowed to undergo a soak period after the initial steam/solvent injection.

DESCRIPTION OF THE PREFERRED EMBODIMENTS

The process of our invention is best applied to a subterranean, viscous oil-containing formation such as a tar sand deposit penetrated by at least one injection well and at least one spaced-apart production well. The injection well is perforated or other fluid flow communication is established between the well and only with the lower 50% or less of the vertical thickness of the formation. The production well is completed in fluid communication with a substantial portion of the vertical thickness of the formation. While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure of which is hereby incorporated by reference. Either naturally occurring or artifically induced fluid communication should exist between the injection well and the production well in the lower part of the oil-containing formation. Fluid communication can be induced by techniques well known in the art such as hydraulic fracturing. This is essential to the proper functioning of our process.

The process of our invention comprises a series of cycles, each cycle consisting of two steps. In the first step of the cycle, a predetermined amount of a mixture of steam and solvent is injected into the formation via the injection well during which time the production well is shut-in thereby causing pressurization of the formation. The pressure at which the mixture of steam and solvent are injected into the formation is generally determined by the pressure at which fracture of the overburden above the formation would occur since the injection pressure must be maintained below the overburden fracture pressure. The amount of steam injected along with the solvent is preferably 300 barrels of steam (cold water equivalent) per acre-foot of formation and the temperature of the steam is within the range of 300° to 700° F. The steam quality is within the range of 50% to about 90%.

The solvent injected along with the steam may be a $C_1$ to $C_{14}$ hydrocarbon including methane, ethane, propane, butane, pentane, hexane, heptane, octane, nonane, decane, undecane, dodecane, tridecane and tetradecane. Carbon dioxide and commercially available solvents such as syncrude, naphtha, light crude oil, kerosene, natural gasoline, or mixtures thereof are also suitable solvents.

The ratio of solvent to steam in the solvent-steam mixture is from about 2 to about 10% by volume.

In an especially preferred embodiment, the solvent is a light solvent such as a $C_1$ to $C_4$ hydrocarbon at a solvent to steam ratio of 2 to 5 volume percent.

After injection of the slug of steam and solvent, the injection well is shut-in and the formation may be allowed to undergo a brief "soaking period" for a variable time depending upon formation characteristics. After steam/solvent injection with the production well shut-in, and a soak period, if one is used, is completed, fluids including oil are recovered from the formation via the production well while maintaining the injection well shut-in thereby initiating a drawdown cycle of the formation. The second phase, production and drawdown cycle is continued until the water cut of the fluid being produced from the formation via the production well increases to a predetermined value, preferably at least 95%.

The oil recovery process is continued with repetitive cycles comprising injection of steam and solvent with the production well shut-in, followed by production with the injection well shut-in, until the oil recovery is uneconomical.

In a slightly different embodiment of the method of our invention, after the initial solvent/steam injection and production cycle, a slug of steam or hot water is injected into the formation via the injection well with the production well shut-in followed by producing fluids including oil with the injection well shut-in until the water cut of the produced fluids rises to a predetermined value, preferably 95%. The amount of steam or hot water injected after the injection of a mixture of steam and solvent is at least 300 barrels per acre-foot of formation. In this embodiment, the sequence of solvent/steam injection-production-steam injection and production may be repeated for a plurality of cycles. In addition, after initial solvent/steam injection and prior to production, the formation may be allowed to undergo a soak period for a variable period of time depending upon formation characteristics.

EXPERIMENTAL SECTION

For the purpose of demonstrating the operability and optimum operating conditions of the process of our invention, the following experimental results are presented.

A heavy oil reservoir was simulated. The reservoir geometry is a two-dimensional cross-sectional pie-shaped model representing one-sixth of an inverted 7-spot pattern consisting of one injection well and one production well. The width of the reservoir affected by steam varied from 3.9 feet closest to the injector and 180 feet at the production well. The distance between the injector and the producer was 132 feet. The completion interval for the injector and producer was in the lower portion of the reservoir. Table 1 below summarizes the major reservoir characteristics.

TABLE 1

| | |
|---|---|
| Thickness (ft) | 200 |
| Porosity | .35 |
| Horizontal Permeability (md) | 2000 |
| Vertical Permeability (md) | 400 |
| Oil Saturation (%) | 60 |
| Water Saturation (%) | 40 |
| Oil Viscosity @ 50° F. (cp) | 87000 |

Three solvents were studied. The heaviest had a molecular weight of 170.3 lb/lb mole. The medium weight solvent was a mixture of $C_6$, $C_8$, $C_{12}$ hydrocarbons having a molecular weight of 131.4. The lightest solvent studied was a propane-type hydrocarbon with a molecular weight of 44. Solvent properties are shown below in Table 2 below.

TABLE 2

| Solvent | Heavy | Medium | Light |
|---|---|---|---|
| Molecular Weight (lb/lb mol) | 170.3 | 131.4 | 44.0 |
| Critical Temperature (°F.) | 1184.9 | 1067.0 | 665.6 |
| Oil Phase Compressibility (l/psi) | .00001 | .00001 | .00022 |
| Stock Tank Density (lbM/cu ft) | 53.4 | 44.9 | 20.0 |
| Heat Capacity (BTU/lbM-°F.) | 0.5 | 0.6 | −1.1843 + .003452 (°F.) |
| Viscosity (cp) | | | |
| 55° F. | 1.73 | 2.24 | .172 |
| 255° F. | .443 | .728 | .119 |
| 455° F. | .208 | .376 | .095 |
| 655° F. | .129 | .240 | .082 |

A steam slug of approximately 35,000 barrels of steam (cold water equivalent) containing 10% solvent was injected during the injection phase with the production well shut-in. This was followed by a production phase wherein the injection well was shut-in and oil produced from the production well. The effect of the solvent was determined by the amount of incremental heavy oil recovered compared to steam alone. Table 3 below summarizes the results.

TABLE 3

STEAM-SOLVENT PROCESS SIMULATION STUDY
STEAM SLUG: 35,000 BBLS

| | | STEAM + SOLVENT (10% BY VOL.) | | |
|---|---|---|---|---|
| | STEAM ONLY | SOLVENT 1 | SOLVENT 2 | SOLVENT 3 |
| SOLVENT MOL. WT. | — | 44 | 131 | 170 |
| CUM. PRODUCTION, STB | | | | |
| HEAVY OIL | 2,616 | 3,055 | 3,194 | 2,934 |
| SOLVENT | — | 2,977 | 825 | 75 |
| WATER | 34,200 | 34,400 | 34,500 | 34,500 |

The results show that steam alone produced 2616 bbls of heavy oil. Coinjecting Solvent 1 (mol. wt.=44) increased heavy oil production to 3060 bbl. Coinjecting Solvent 2 (mol. wt.=131) increased heavy oil production to 3190 bbl. Coinjection of Solvent 3 increased heavy oil production to 2930. The results show that all solvents mixed with steam increased heavy oil production.

Since Solvent 1 recovers additional heavy oil with the least loss of solvent, it is considered the most efficient solvent. We further varied the amount of Solvent 1 injected with steam. These results are shown in Table 4 below.

TABLE 4

STEAM-SOLVENT PROCESS SIMULATION STUDY
STEAM SLUG: 35,000 BBLS

| | STEAM ONLY | AMT. OF SOLVENT 1, VOL % OF STEAM 3.3 % Vol. | 10% Vol. |
|---|---|---|---|
| CUM. PRODUCTION, STB | | | |
| HEAVY OIL | 2,616 | 3,794 | 3,055 |
| SOLVENT 1 | — | 1,049 | 2,977 |
| WATER | 34,200 | 34,160 | 34,400 |
| SOLVENT UNRECOVERED, STB | — | 129 | 567 |
| INC. OIL/SOLV. UNRECOVERED | — | 1.38 | 0.77 |

These results show that the optimum concentration for the light Solvent 1 is within the range of 2 to 5 volume percent.

Additional tests were conducted in which following the injection of a slug of a mixture of steam and solvent, a slug of steam or hot water was injected. These results are summarized in Tables 5 and 6 below.

TABLE 5

STEAM-SOLVENT SLUG FOLLOWED BY A STEAM SLUG
1st STEAM SLUG: 35,000 BBLS
2d STEAM SLUG: 36,000 BBLS

| CUM. STEAM CYCLE PROD., STB | 1st CYCLE SOLVENT (10% BY VOL.) SOLVENT 1 | SOLVENT 2 | SOLVENT 3 |
|---|---|---|---|
| HEAVY OIL | 5,622 | 7,466 | 7,466 |
| SOLVENT | 27 | 562 | 381 |

TABLE 6

STEAM-SOLVENT SLUG FOLLOWED BY A HOT WATER SLUG
1st STEAM SLUG: 35,000 BBLS
2d HOT WATER SLUG: 36,000 BBLS

| CUM. HOT WATER CYCLE PROD., STB | 1st CYCLE SOLVENT (10% BY VOL.) SOLVENT 1 | SOLVENT 2 | SOLVENT 3 |
|---|---|---|---|
| HEAVY OIL | 3,810 | 4,360 | 5,445 |
| SOLVENT | 179 | 652 | 433 |

These results clearly show that cumulative oil recovery is substantially more for the steam and hot water injection cycles compared to the steam/solvent cycle shown in Table 3. Therefore, a combined steam/solvent and steam injection cycle would significantly increase overall oil recovery.

What is claimed is:

1. A method for recovering oil from a subterranean, viscous oil-containing formation including a tar sand deposit, said formation being penetrated by at least one injection well in fluid communication with only the lower 50% or less of the oil-containing formation and by at least one spaced-apart production well in fluid communication with a substantial portion of the oil-containing formation, said injection well and said production well having a fluid communication relationship in the bottom zone of the formation, comprising:

(a) injecting into the formation via the injection well a predetermined amount of a mixture of steam and a solvent with the production well shut-in;

(b) shutting-in the injection well and recovering fluids including oil from the formation via the production well until the fluid being recovered comprises a predetermined amount of water;

(c) shutting-in the production well and injecting a predetermined amount of steam or hot water; and (d) shutting-in the injection well and recovering fluids including oil from the formation via the production well until the fluid being recovered comprises a predetermined amount of water.

2. The method of claim 1 wherein steps (a), (b), (c), and (d) are repeated for a plurality of cycles.

3. The method of claim 1 wherein the amount of steam injected with the solvent is about 300 barrels of steam (cold water equivalent) per acre-foot of formation.

4. The method of claim 1 wherein the temperature of the steam is within the range of 300° to 700° F. and the steam quantity is 50 to about 90%.

5. The method of claim 1 wherein the solvent is selected from the group consisting of methane, ethane, propane, butane, pentane, hexane, heptane, octane, nonane, decane, undecane, dodecane, tridecane, tetradecane, carbon dioxide, naphtha, kerosene, natural gasoline, syncrude, light crude oil and mixtures thereof.

6. The method of claim 1 wherein the ratio of solvent to steam is within the range of 2 to about 10 volume percent.

7. The method of claim 1 wherein the solvent comprises a light $C_1$ to $C_4$ hydrocarbon and the ratio of solvent to steam is within the range of 2 to about 5 volume percent.

8. The method of claim 1 wherein production is continued during step (b) until the fluid being recovered from the formation contains at least 95% water.

9. The method of claim 1 further including the step of leaving the steam/solvent mixture injected into the formation in step (a) in the formation for a soak period prior to the oil production in step (b).

10. The method of claim 1 wherein the amount of steam or hot water injected during step (c) is at least 300 barrels per acre-foot of formation.

* * * * *